US011287764B1

(12) United States Patent
Yoshioka et al.

(10) Patent No.: US 11,287,764 B1
(45) Date of Patent: Mar. 29, 2022

(54) IMAGE FORMING APPARATUS CAPABLE OF PREVENTING A DISCHARGE DEFECT IN AN IMAGE

(71) Applicant: FUJIFILM Business Innovation Corp., Tokyo (JP)

(72) Inventors: Tomoaki Yoshioka, Kanagawa (JP); Yoko Miyamoto, Kanagawa (JP); Toshiaki Baba, Kanagawa (JP); Tomohiro Wada, Kanagawa (JP); Kazuyoshi Hagiwara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/308,556

(22) Filed: May 5, 2021

(30) Foreign Application Priority Data

Sep. 18, 2020 (JP) ..... JP2020-157546

(51) Int. Cl.
*G03G 15/16* (2006.01)

(52) U.S. Cl.
CPC ..... *G03G 15/1615* (2013.01)

(58) Field of Classification Search
CPC ..... G03G 15/1615; G03G 15/1655
USPC ..... 399/303, 304
See application file for complete search history.

(56) References Cited

U.S. PATENT DOCUMENTS 3,947,113 A * 3/1976 Buchan et al. .... G03G 15/1615 399/308

FOREIGN PATENT DOCUMENTS

JP 58-005769 A 1/1983

* cited by examiner

*Primary Examiner* — William J Royer
(74) *Attorney, Agent, or Firm* — Sughrue Mion, PLLC

(57) ABSTRACT

An image forming apparatus includes: a rotating body; a sprocket provided coaxially with the rotating body, the sprocket being configured to rotate integrally with the rotating body; a chain including a holder configured to hold a leading end portion of a recording medium, the chain being wound on the sprocket, the chain being configured to rotate so as to transport the recording medium; an annular shaped transfer belt supported by an opposing member opposing the rotating body at an opposing position, the transfer belt being configured to sandwich the recording medium transported by the chain between the transfer belt and the rotating body at the opposing position, in which an image on an outer peripheral surface of the transfer belt is transferred to the recording medium in response to a transfer bias being applied between the rotating body and the opposing member; and a forming member that supports the transfer belt on an upstream side of the opposing position in a transport direction, the forming member being configured to form a contact region in which the transfer belt is brought into contact with the rotating body on the upstream side of the opposing position in the transport direction.

20 Claims, 6 Drawing Sheets

| PRESSURE | 0.5kPa | 1kPa | 1.5kPa | 2kPa | 15kPa | 16kPa | 17kPa |
|---|---|---|---|---|---|---|---|
| DISCHARGE DEFECT | C | B | A | A | | | |
| IMAGE SCATTERING | | | | | A | B | C |

| | 7mm | 8mm | 10mm | 11mm | 50mm | 52mm | 55mm |
|---|---|---|---|---|---|---|---|
| DISCHARGE DEFECT | C | B | A | A | | | |
| IMAGE ABRASION DEFECT | | | | | A | B | C |

IMAGE FORMING APPARATUS CAPABLE OF PREVENTING A DISCHARGE DEFECT IN AN IMAGE

CROSS-REFERENCE TO RELATED APPLICATIONS

This application is based on and claims priority under 35 USC 119 from Japanese Patent Application No. 2020-157546 filed Sep. 18, 2020.

BACKGROUND

(i) Technical Field

The present disclosure relates to an image forming apparatus.

(ii) Related Art

JP-A-58-005769 discloses a transfer device for transferring an image on an image carrier. The transfer device includes a transferred material transporting unit, a gripper piece, and a switch member. The transferred material transporting unit moves a transferred material in an endless manner along a circulating movement path. The gripper piece is attached to the transferred material transporting unit. The gripper piece is pivotally supported by a rotating shaft. The gripper piece rotates relative to a base member. The gripper piece holds a leading end side of the transferred material. The switch member is attached to a base member side. In order to detect whether the transferred material is in the gripper piece, a part of a switch member position in the gripper piece is cut out.

SUMMARY

Consider an image forming apparatus including a rotating body, a sprocket, a chain, and an annular shaped transfer belt. The sprocket rotates integrally with the rotating body. The chain includes a holder that holds a leading end portion of a recording medium. The chain is wound on the sprocket. The chain rotates to transport the recording medium. The transfer belt is supported by an opposing member opposing the rotating body at an opposing position. The transfer belt sandwiches the recording medium transported by the chain between the transfer belt and the rotating body at the opposing position. An image on an outer peripheral surface of the transfer belt is transferred to the recording medium in response to a transfer bias being applied between the rotating body and the opposing member.

In the image forming apparatus, if the transfer belt is not in contact with the rotating body on an upstream side of the opposing position, when vibration generated by the rotation of the chain is transmitted to the transfer belt via the sprocket and the rotating body, the transfer belt is likely to vibrate. Vibration of the transfer belt may cause a discharge between the transfer belt and the rotating body, which may generate a discharge defect in the image.

Aspects of non-limiting embodiments of the present disclosure relate to preventing a discharge defect in an image as compared to a configuration in which a transfer belt is not in contact with a rotating body on an upstream side of an opposing position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus includes: a rotating body; a sprocket provided coaxially with the rotating body, the sprocket being configured to rotate integrally with the rotating body; a chain including a holder configured to hold a leading end portion of a recording medium, the chain being wound on the sprocket, the chain being configured to rotate so as to transport the recording medium; an annular shaped transfer belt supported by an opposing member opposing the rotating body at an opposing position, the transfer belt being configured to sandwich the recording medium transported by the chain between the transfer belt and the rotating body at the opposing position, in which an image on an outer peripheral surface of the transfer belt is transferred to the recording medium in response to a transfer bias being applied between the rotating body and the opposing member; and a forming member that supports the transfer belt on an upstream side of the opposing position in a transport direction, the forming member being configured to form a contact region in which the transfer belt is brought into contact with the rotating body on the upstream side of the opposing position in the transport direction.

BRIEF DESCRIPTION OF THE DRAWINGS

Exemplary embodiment(s) of the present disclosure will be described in detail based on the following figures, wherein.

DETAILED DESCRIPTION

Hereinafter, an exemplary embodiment according to the present disclosure will be described with reference to the accompanying drawings.

Image Forming Apparatus 10

Figure 1:
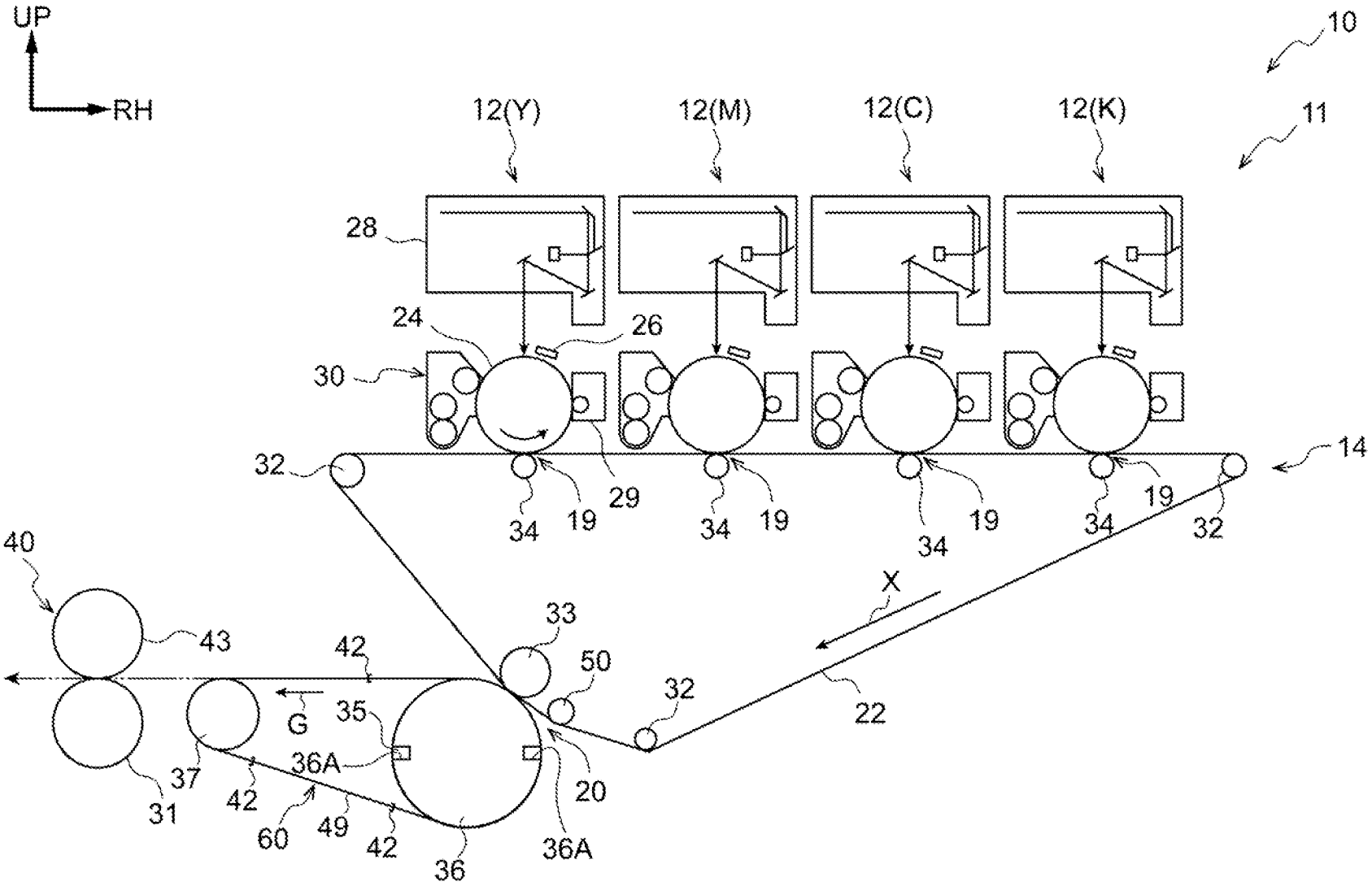
FIG. 1 is a front view showing a schematic configuration of an image forming apparatus according to an exemplary embodiment.

First, a configuration of an image forming apparatus 10 will be described. FIG. 1 is a front view showing a schematic configuration of the image forming apparatus 10 according to the present exemplary embodiment. An arrow UP shown in each drawing indicates an up direction of the image forming apparatus 10 which is an up direction of vertical directions. As shown in FIG. 1, an arrow RH indicates one direction of horizontal directions which is, specifically, a right direction when the image forming apparatus 10 is viewed from the front side. In the following description, the term "up and down direction" refers to the up and down direction of the image forming apparatus 10 when viewed from the front side of the image forming apparatus 10 as shown in FIG. 1, unless otherwise specified. Similarly, the term "right and left direction" refers to the right and left direction of the image forming apparatus 10 when viewed from the front side of the image forming apparatus 10 as shown in FIG. 1, unless otherwise specified. Furthermore, the term "front and rear direction" refers to a front and rear direction of the image forming apparatus 10 when viewed from the front side of the image forming apparatus 10 as shown in FIG. 1 (that is, a direction extending in and out of the page), unless otherwise specified.

The image forming apparatus 10 is an electrophotographic image forming apparatus that forms a toner image (an example of an image) on a sheet P (an example of a recording medium). Specifically, as shown in FIG. 1, the image forming apparatus 10 includes a transport mechanism 60, an image forming unit 11, and a fixing device 40.

Transport Mechanism 60

Figure 2:
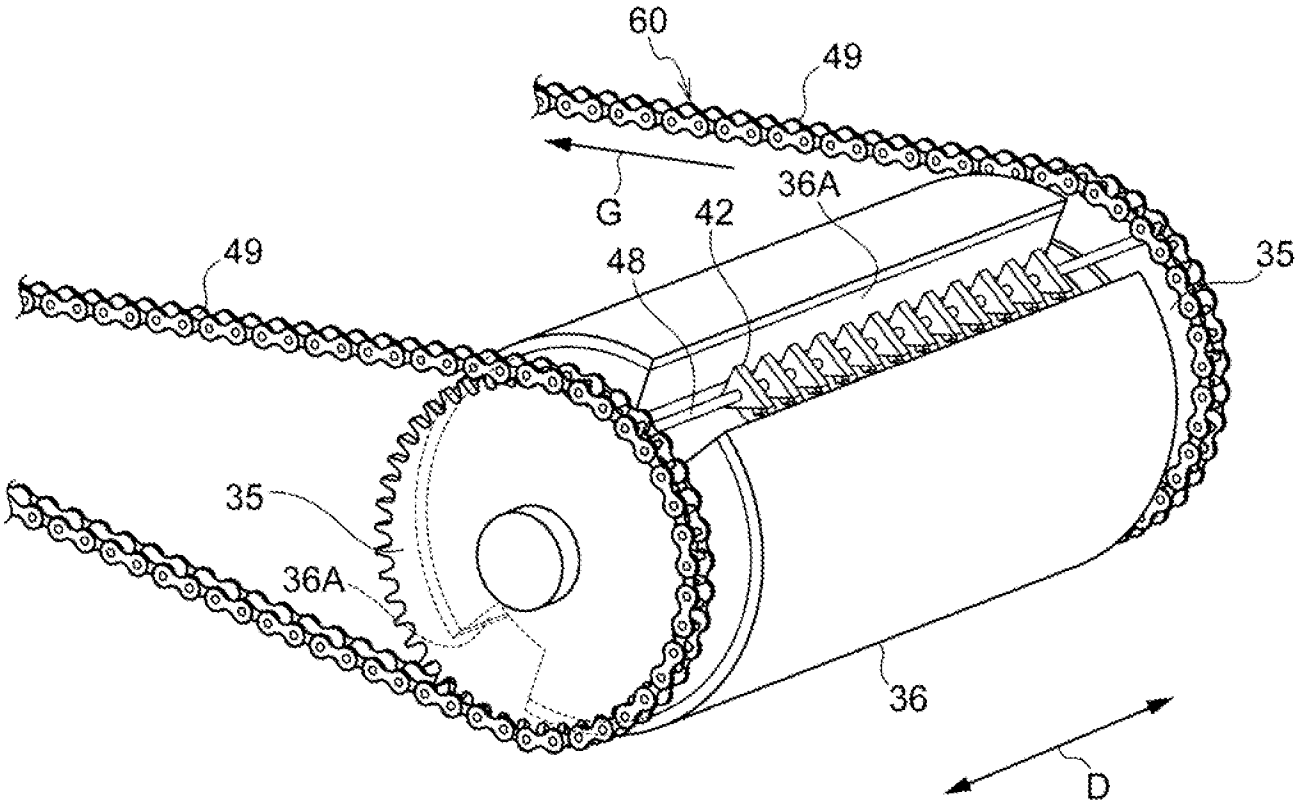
FIG. 2 is a perspective view showing chains, sprockets, and a rotating body of the image forming apparatus according to the exemplary embodiment.

The transport mechanism 60 is a mechanism that transports the sheet P. Specifically, as shown in FIGS. 1 and 2, the transport mechanism 60 includes grippers 42, and a pair of chains 49. The gripper 42 is an example of a holder. As shown in FIG. 1, each chain 49 is formed in an annular shape. As shown in FIG. 2, the chains 49 are arranged at an interval in the front and rear direction (specifically, D directions in FIG. 2). FIG. 1 shows the chain 49 disposed on the front side among the pair of chains 49. In FIG. 1, the chains 49 and the grippers 42 are shown in a simplified manner.

Each chain 49 is wound on a respective one of sprockets 35 as shown in FIG. 2 and on a respective one of sprockets 37 (see FIG. 1). The sprockets 35 are disposed near respective axial ends of a rotating body 36. The sprockets 37 are arranged at an interval in the front and rear direction.

The sprockets 35 are provided coaxially with the rotating body 36, and rotate integrally with the rotating body 36. In the present exemplary embodiment, the pair of sprockets 35 rotates integrally with the rotating body 36, so that the chains 49 rotate in a direction of an arrow G. The chains 49 may be rotated as the sprockets 37 are rotationally driven. In the figures other than FIG. 2, teeth provided on outer peripheries of the sprockets 35 and 37 are omitted.

Figure 3:
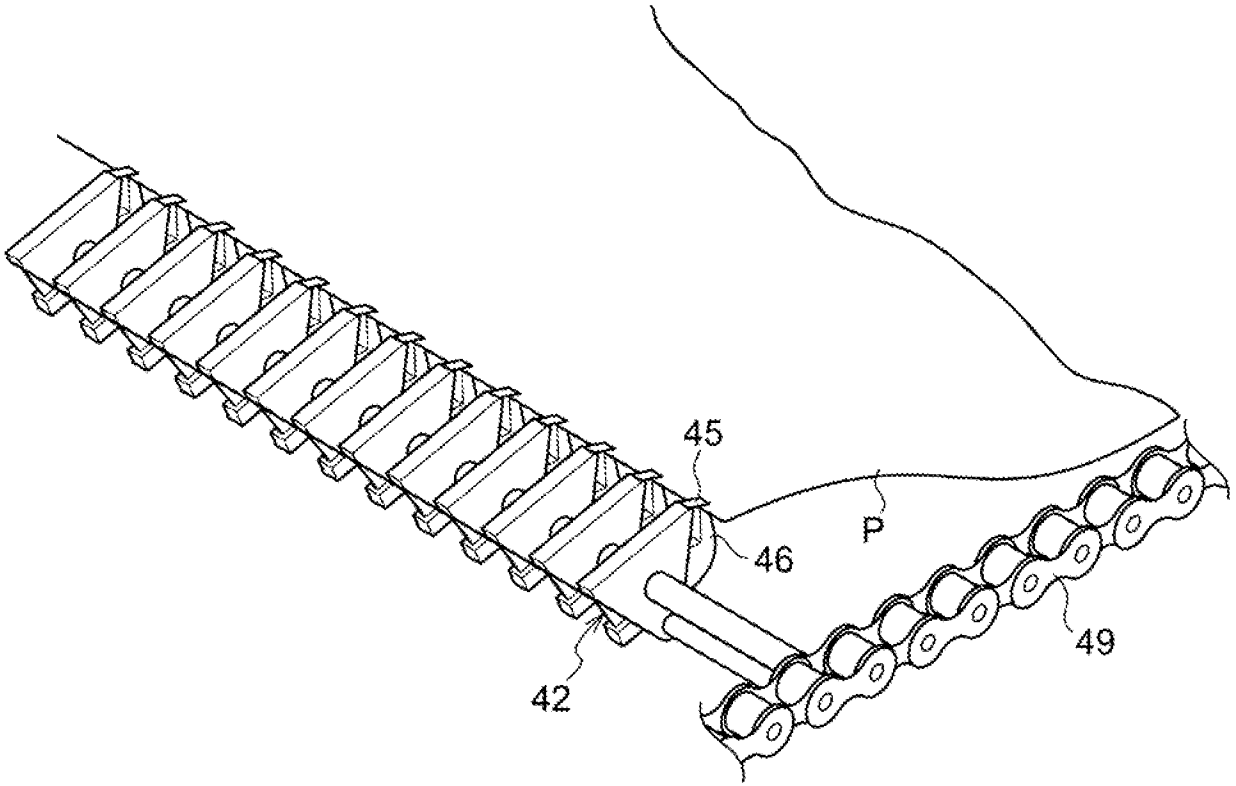
FIG. 3 is a perspective view showing a state in which a sheet is held by a gripper of the image forming apparatus according to the exemplary embodiment.

As shown in FIG. 2, the gripper 42 is attached to an attachment member 48 that is disposed between the chains 49 along the front and rear direction of the image forming apparatus 10. Respective end portions of the attachment member 48 in a longitudinal direction are attached to the chains 49. The gripper 42 has a function of holding a leading end portion of the sheet P. Specifically, as shown in FIG. 3, the gripper 42 includes pawls 45 and pawl bases 46. The gripper 42 holds the sheet P by sandwiching the leading end portion of the sheet P between the pawls 45 and the pawl bases 46. In the gripper 42, for example, the pawl 45 is pressed against the pawl base 46 by a spring or the like, and the pawl 45 is opened and closed relative to the pawl base 46 by an action of a cam or the like.

As shown in FIG. 3, in the transport mechanism 60, the gripper 42 holds the leading end portion of the sheet P sent from an accommodating unit (not illustrated) that accommodates the sheets P. In the transport mechanism 60, the chains 49 rotate in the direction of the arrow G in a state in which the gripper 42 holds the leading end portion of the sheet P, to thereby transport the sheet P and cause the sheet P to pass through an opposing position 20 (that is, a secondary transfer position) as described later (see FIG. 1). Furthermore, the transport mechanism 60 transports the sheet P to the fixing device 40 after the sheet P passes through the opposing position 20 (that is, the secondary transfer position).

Image Forming Unit 11

The image forming unit 11 shown in FIG. 1 has a function of forming an image on the recording medium. Specifically, as shown in FIG. 1, the image forming unit 11 includes image forming units 12 that form toner images using an electrophotographic technique, and a transfer device 14 that transfers the toner images formed by the image forming units 12 to the sheet P.

Image Forming Unit 12

The plural image forming units 12 are provided so as to form the toner images of the respective colors. In the present exemplary embodiment, the image forming units 12 of four colors of yellow (Y), magenta (M), cyan (C), and black (K) are provided. Reference signs (Y), (M), (C), and (K) shown in FIG. 1 represent constituent parts corresponding to the respective colors. Since the image forming units 12 of the respective colors have similar configuration except toners to be used, reference signs are given to respective elements of the toner image forming unit 12 (Y) in FIG. 1 as a representative of the toner image forming units 12 of the respective colors.

The image forming unit 12 of each color includes a rotating cylindrical photoconductor 24 and a charger 26 that charges the photoconductor 24. The image forming unit 12 further includes an exposure device 28 that irradiates the charged photoconductor 24 with exposure light to form an electrostatic latent image, and a developing device 30 that develops the electrostatic latent image with a developer containing the toner into an image formed of a toner layer. The image forming unit 12 further includes a cleaner 29 that removes the toner remaining on the surface of the photoconductor 24 after the toner is transferred from the photoconductor 24 to a transfer belt 22.

Transfer Device 14

The transfer device 14 shown in FIG. 1 has a function of primarily transferring the toner images of the photoconductors 24 of the respective colors onto the transfer belt 22 (which serves as an intermediate transfer body) in a superimposed manner, and secondarily transferring the superimposed toner images onto the sheet P. Specifically, as shown in FIG. 1, the transfer device 14 includes the transfer belt 22 as the intermediate transfer body, primary transfer rollers 34, the rotating body 36, and an opposing roller 33. The rotating body 36 is an example of a rotating body. The opposing roller 33 is an example of an opposing member.

The primary transfer roller 34 has a function of transferring the toner image formed on the photoconductor 24 to an outer peripheral surface of the transfer belt 22 at a primary transfer position 19 between the photoconductor 24 and the primary transfer roller 34.

As shown in FIG. 1, the transfer belt 22 has an endless shape (that is, an annular shape). The transfer belt 22 is wound on the opposing roller 33 and plural rollers 32, so that the transfer belt 22 is supported by the opposing roller 33 and the rollers 32 and the posture of the transfer belt 22 is determined. By rotationally driving at least one of the plural rollers 32, the transfer belt 22 rotates in a direction of an arrow X, and transports the primarily transferred images to the opposing position 20.

The rotating body 36 has a function of transferring the toner image, which has been transferred to the transfer belt 22, to the sheet P. The rotating body 36 is disposed on a lower left side of the transfer belt 22 so as to oppose the transfer belt 22. The rotating body 36 has a cylindrical shape whose axial direction is the front and rear direction. As described above, the rotating body 36 rotates integrally with the sprockets 35. Recesses 36A that prevents interference with the grippers 42 are formed in the rotating body 36. In passing between the rotating body 36 and the opposing roller 33, the gripper 42 is accommodated in the recess 36.

The opposing roller 33 opposes the rotating body 36 at the predetermined opposing position 20 in a state in which the transfer belt 22 is disposed between the opposing roller 33 and the rotating body 36. Specifically, the opposing roller 33 is disposed on an upper right side of the rotating body 36.

In the transfer device 14, the sheet P transported by the grippers 42 and the chains 49 is sandwiched between the transfer belt 22 and the rotating body 36 at the opposing position 20, and the toner image, which has been transferred to the outer peripheral surface of the transfer belt 22 is transferred to the sheet P at the opposing position 20 by an electrostatic force generated by applying a secondary transfer bias between the rotating body 36 and the opposing roller 33. Therefore, the opposing position 20 may be said to be a "secondary transfer position" at which an image is secondarily transferred. Furthermore, the opposing position 20 may be said to be an "image formation position" at which an image is formed on the sheet P. The opposing position 20 may also be said to be a "sandwiched position" (that is, a sandwiched region) where the sheet P is sandwiched between the transfer belt 22 (that is, the opposing roller 33) and the rotating body 36. Furthermore, the opposing position 20 may be said to be a position where the opposing roller 33 and the transfer belt 22 come into contact with each other (that is, a "contact region").

Fixing Device 40

The fixing device 40 shown in FIG. 1 is a device that fixes an image on the sheet P to the sheet P. Specifically, the fixing device 40 includes a heating roller 43 and a pressure roller 31. In the fixing device 40, the image transferred to the sheet P is fixed to the sheet P by heating by the heating roller 43 and pressing by the pressure roller 31.

Configuration around Support Roller 50

Next, a configuration around a support roller 50 according to the present exemplary embodiment will be described.

Figure 4:
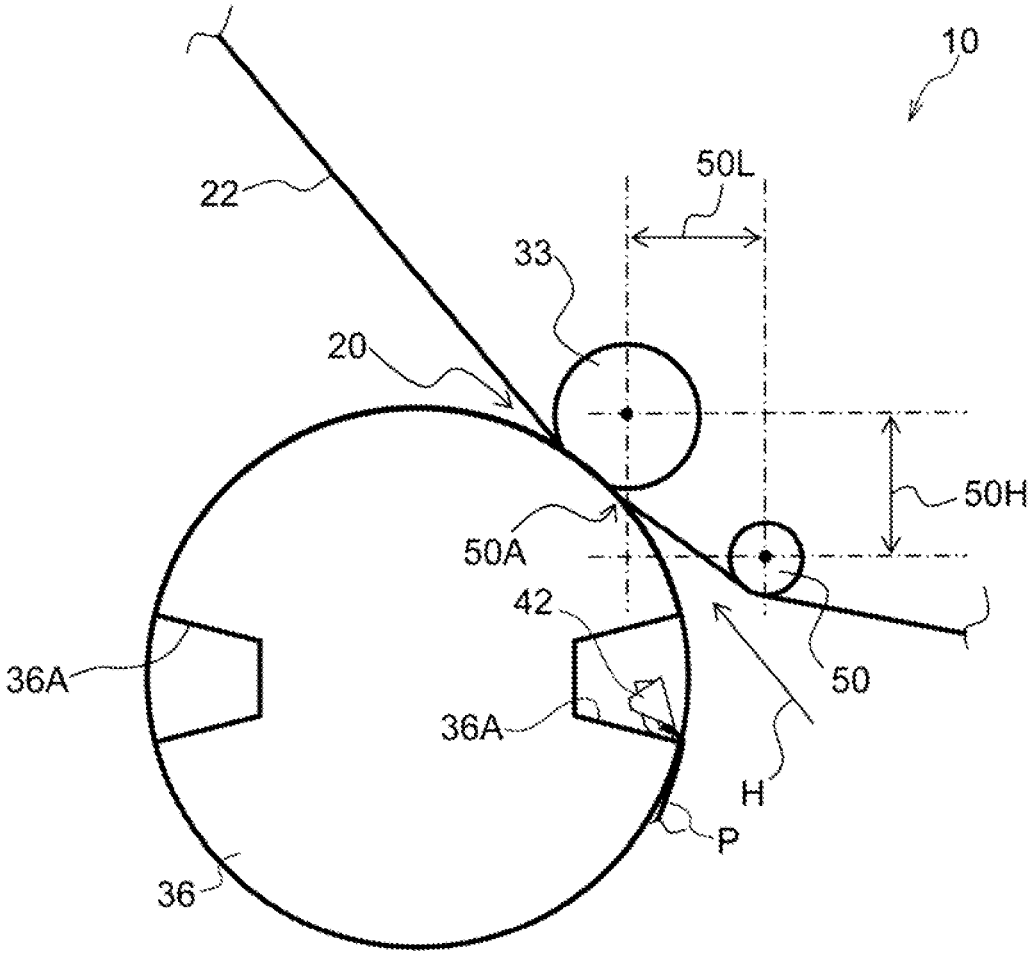
FIG. 4 is a front view showing a configuration around a support roller of the image forming apparatus according to the exemplary embodiment.

As shown in FIG. 4, the image forming apparatus 10 includes a support roller 50 that supports the transfer belt 22 on an upstream side of the opposing position 20 in a transport direction (a direction of an arrow H). The support roller 50 forms a contact region 50A in which the transfer belt 22 is brought into contact with the rotating body 36 on the upstream side of the opposing position 20 in the transport direction H.

In the present exemplary embodiment, in a state where the image forming apparatus 10 is stopped, a non-contact part where the opposing roller 33 and the rotating body 36 are not in contact with each other is present on the upstream side of a contact part where the opposing roller 33 and the rotating body 36 are in contact with each other. A region in which the transfer belt 22 and the rotating body 36 are in contact with each other (that is, the contact region 50A) is present on a downstream side of the non-contact part. The contact part may be said to be a part in which the opposing roller 33 and the transfer belt 22 are in contact with each other. The non-contact part may be said to be a portion in which the opposing roller 33 and the transfer belt 22 are not in contact with each other.

The support roller 50 is, for example, a roller including a cylindrical base member and a rubber layer formed on an outer periphery of the base member. The support roller 50 is a driven roller that rotates following the transfer belt 22. The support roller 50 is an example of a forming member, and is an example of a forming roller.

The support roller 50, the rotating body 36, and the opposing roller 33 satisfy the following relationship:

the outer diameter of the rotating body 36>the outer diameter of the opposing roller 33≥the outer diameter of support roller 50.

The support roller 50 and the opposing roller 33 may further satisfy the following relationship:

the outer diameter of the opposing roller 33>the outer diameter of the support roller 50.

More specifically, the outer diameter of the rotating body 36 is, for example, 200 mm or more and 300 mm or less. The outer diameter of the opposing roller 33 is, for example, 50 mm or more and 60 mm or less. The outer diameter of the support roller 50 is, for example, 20 mm or more and 30 mm or less. For example, the outer diameter of the support roller 50 may be small enough so that a deflection of the support roller 50 due to a load applied from the transfer belt 22 is equal to or less than an allowable value (for example, 10 μm or less). Since the outer diameter of the support roller 50 is small, the support roller 50 can be brought close to the opposing roller 33. By bringing the support roller 50 close to the opposing roller 33, a pressure applied to the rotating body 36 in the contact region 50A can be increased.

The support roller 50 is separated from the opposing roller 33 in the horizontal direction by a predetermined distance 50L. Specifically, the support roller 50 is disposed on the right side of the opposing roller 33. The support roller 50 is disposed below the opposing roller 33 by a predetermined height 50H.

The predetermined distance 50L is a distance between the center of the support roller 50 and the center of the opposing roller 33 along the horizontal direction, and is, for example, 40 mm or more and 70 mm or less. The predetermined height 50H is a distance between the center of the support roller 50 and the center of the opposing roller 33 along the up and down direction, and is, for example, 45 mm or more and 80 mm or less.

A pressure is applied to the transfer belt 22 in the contact region 50A such that the transfer belt 22 is brought into close contact with the sheet P transported by the chains 49. The term "close contact" means that the sheet P transported as the chains 49 rotate in a state where the leading end portion of the sheet P is held by the gripper 42 and the transfer belt 22 are kept in contact with each other in the contact region 50A.

Specifically, a pressure of 1.5 kPa or more is applied to the transfer belt 22 in the contact region 50A (specifically, at a center of the contact region 50A). The pressure applied to the transfer belt 22 in the contact region 50A may be 3.0 kPa or more. The pressure applied to the transfer belt 22 in the contact region 50A is 15 kPa or less. That is, in the present exemplary embodiment, the pressure in a range of 1.5 kPa or more and 15 kPa or less is applied to the transfer belt 22 in the contact region 50A. The pressure is a pressure that the transfer belt 22 applies to the rotating body 36.

The pressure can be adjusted using a position of the support roller 50 and a tension of the transfer belt 22. Specifically, when the position of the support roller 50 is close to the opposing roller 33, the pressure is increased. When the tension of the transfer belt 22 is large, the pressure is increased.

Figure 5:
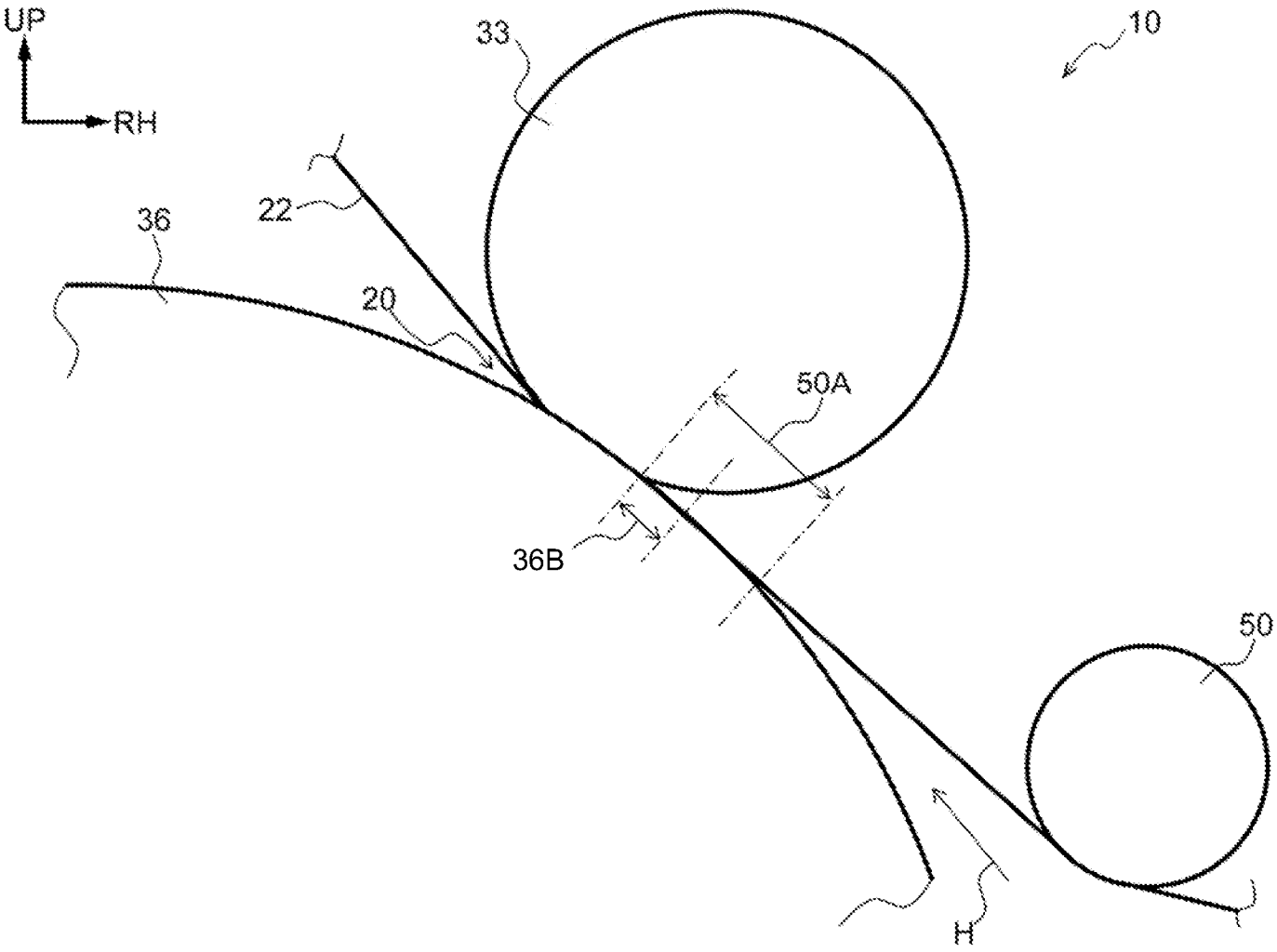
FIG. 5 is an enlarged front view showing surroundings of the support roller of the image forming apparatus according to the exemplary embodiment.

As shown in FIG. 5, the contact region 50A is broader than an electric field region 36B formed on the upstream side of the opposing position 20 in the transport direction by an application of a transfer bias between the rotating body 36 and the opposing roller 33. When the transfer bias is 2.0 kV or more and 3.5 kV or less, the electric field region 36B is formed in a range of about 7 mm on the upstream side of the opposing position 20 in the transporting direction. The electric field region 36B is a region in which the toner on the transfer belt 22 is transferred to the sheet P. The electric field region 36B can be checked by analyzing where the toner is transferred to the sheet P.

In contrast, in the present exemplary embodiment, the contact region 50A is formed in a range of 10 mm or more. The contact region 50A is formed in a range of 50 mm or less.

From a viewpoint of preventing a vibration of the rotating body 36, a mass of the rotating body 36 may be large. The mass of the rotating body 36 is, for example, 80 kg or more and 150 kg or less. The rotating body 36 is made of aluminum. From a viewpoint of preventing the vibration of the transfer belt 22, the tension of the transfer belt 22 may be high. The tension of the transfer belt 22 is 300N or more and 500N or less.

Action of Present Exemplary Embodiment

In the present exemplary embodiment, as described above, the support roller 50 forms the contact region 50A in which the transfer belt 22 is brought into contact with the rotating body 36 on the upstream side of the opposing position 20 in the transport direction.

Figures 6, 7, 8:
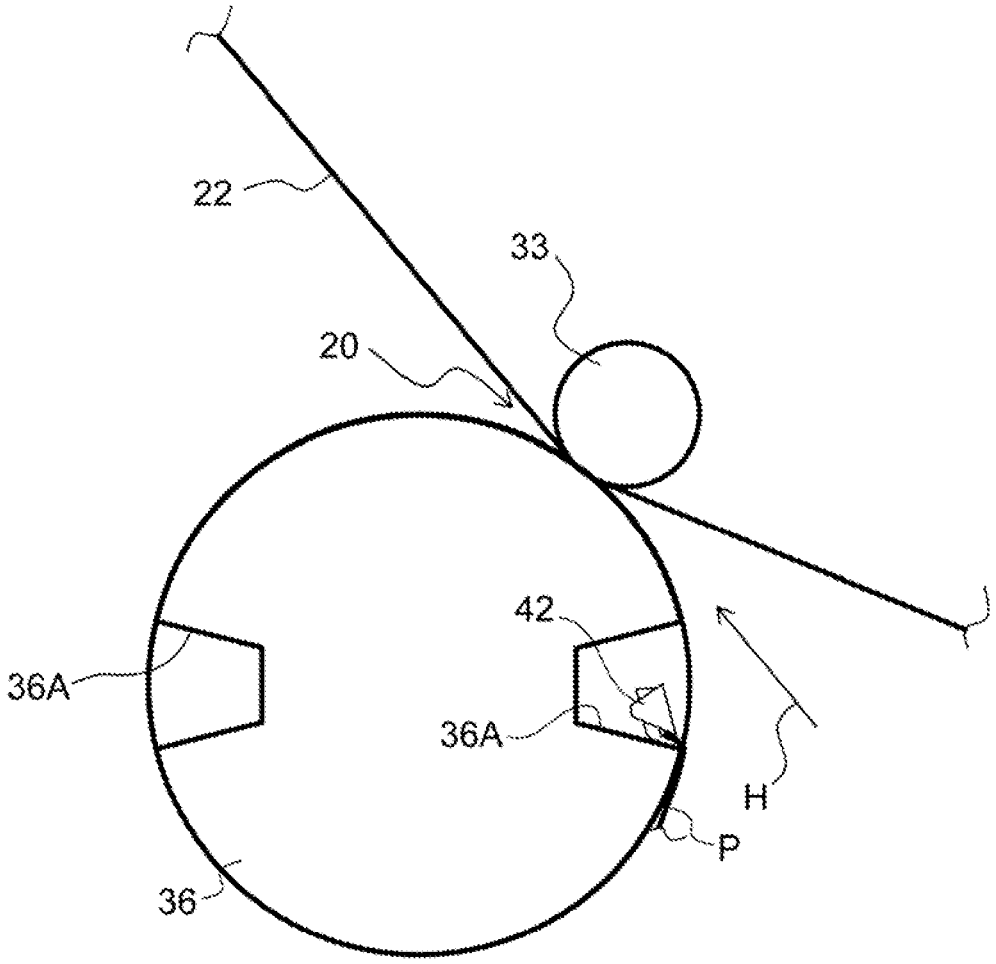
FIG. 6 is a front view showing a configuration around a support roller of an image forming apparatus according to a comparative example.
FIG. 7 is a table showing evaluation results in evaluation 1.
FIG. 8 is a table showing evaluation results in evaluation 2.

Here, FIG. 6 shows a configuration in which the transfer belt 22 is not in contact with the rotating body 36 on the upstream side of the opposing position 20 (hereinafter, this configuration will be referred to as a "first configuration"). If vibration generated due to the rotation of the chains 49 is transmitted to the transfer belt 22 via the sprockets 35 and the rotating body 36 (see FIG. 2), the transfer belt 22 is likely to vibrate. If the transfer belt 22 vibrates, a gap may be formed between the transfer belt 22 and the rotating body 36, and a discharge may occur between the transfer belt 22 and the rotating body 36. If discharge occurs between the transfer belt 22 and the rotating body 36, a discharge defect may occur in the toner image to be transferred to the sheet P.

In contrast, as described above, in the present exemplary embodiment, the support roller 50 forms the contact region 50A on the upstream side of the opposing position 20 in the transport direction H. Therefore, the transfer belt 22 is less likely to vibrate, and a gap is less likely to be formed between the transfer belt 22 and the rotating body 36 than in the first configuration. Accordingly, as compared to the first configuration, discharge is less likely to occur between the transfer belt 22 and the rotating body 36, and the discharge defect in the toner image to be transferred to the sheet P is prevented.

In the present exemplary embodiment, the support roller 50, the rotating body 36, and the opposing roller 33 satisfy the following relationship:

the outer diameter of the rotating body 36>the outer diameter of the opposing roller 33≥the outer diameter of support roller 50.

Therefore, the support roller 50 is brought closer to the opposing roller 33 than in a configuration in which the outer diameter of the opposing roller 33<the outer diameter of the support roller 50. Accordingly, a degree of freedom of the arrangement of the support roller 50 is enhanced. By bringing the support roller 50 close to the opposing roller 33, a pressure applied to the rotating body 36 in the contact region 50A can be increased.

Specifically, in the present exemplary embodiment, the support roller 50 and the opposing roller 33 satisfy the following relationship:

the outer diameter of the opposing roller 33>the outer diameter of the support roller 50.

Therefore, the support roller 50 is brought closer to the opposing roller 33 than in a configuration in which the outer diameter of the opposing roller 33=the outer diameter of the support roller 50. Accordingly, a degree of freedom of the arrangement of the support roller 50 is enhanced. By bringing the support roller 50 close to the opposing roller 33, a pressure applied to the rotating body 36 in the contact region 50A can be increased.

In the present exemplary embodiment, a pressure is applied to the transfer belt 22 in the contact region 50A so as to bring the transfer belt 22 into close contact with the sheet P transported by the chains 49. Therefore, as compared to a configuration in which a gap is formed between the transfer belt 22 and the sheet P in transporting the sheet P, discharge is less likely to occur between the transfer belt 22 and the rotating body 36, and the discharge defect in the toner image transferred to the sheet P is prevented.

Specifically, in the present exemplary embodiment, as described above, the pressure of 1.5 kPa or more is applied to the transfer belt 22 in the contact region 50A. Here, consider a configuration in which a pressure of less than 1.5 kPa is applied to the transfer belt 22 in the contact region 50A (hereinafter, this configuration will be referred to as a "second configuration"). Since the pressure is weak in the second configuration, a gap is likely to be formed between the transfer belt 22 and the sheet P in transporting the sheet P. Therefore, in the second configuration, discharge is likely to occur between the transfer belt 22 and the rotating body 36, and the discharge defect may occur in the toner image to be transferred to the sheet P.

In contrast, as described above, in the present exemplary embodiment, the pressure of 1.5 kPa or more is applied to the transfer belt 22 in the contact region 50A. Therefore, a gap is less likely to be formed between the transfer belt 22 and the sheet P in transporting the sheet P than in the second configuration. Therefore, in the present exemplary embodiment, as compared to the second configuration, discharge is less likely to occur between the transfer belt 22 and the rotating body 36, and the discharge defect in the toner image to be transferred to the sheet P is prevented.

In the present exemplary embodiment, the pressure of 15 kPa or less is applied to the transfer belt 22 in the contact region 50A. Here, consider a configuration in which a pressure exceeding 15 kPa is applied to the transfer belt 22 in the contact region 50A (hereinafter, this configuration will be referred to as a "third configuration"). Since the pressure in the contact region 50A is high in the third configuration, for example, a part of a toner image extending in the front and rear direction may be scattered toward the upstream side in the transport direction H (so-called image scattering). In contrast, as described above, in the present exemplary embodiment, the pressure of 15 kPa or less is applied to the transfer belt 22 in the contact region 50A. Therefore, the image scattering is less likely to occur than in the third configuration.

In the present exemplary embodiment, as described above and shown in FIG. 5, the contact region 50A is broader than the electric field region 36B formed on the upstream side of the opposing position 20 in the transport direction by the application of the transfer bias between the rotating body 36 and the opposing roller 33.

Here, consider a configuration in which the contact region 50A is narrower than the electric field region 36B on the upstream side of the opposing position 20 in the transport direction H (hereinafter, this configuration will be referred to as a "fourth configuration"). In the fourth configuration, a gap is likely to be formed between the transfer belt 22 and the rotating body 36 in the electric field region 36B, and discharge may occur between the transfer belt 22 and the rotating body 36. If discharge occurs between the transfer belt 22 and the rotating body 36, a discharge defect may occur in the toner image to be transferred to the sheet P.

In contrast, in the present exemplary embodiment, as described above and shown in FIG. 5, the contact region 50A is broader than the electric field region 36B on the upstream side of the opposing position 20 in the transport direction H. Therefore, as compared to the fourth configuration, the gap is less likely to be formed between the transfer belt 22 and the rotating body 36 in the electric field region 36B, and the discharge is less likely to occur between the transfer belt 22 and the rotating body 36. Therefore, in the present exemplary embodiment, as compared to the fourth configuration, the discharge defect in the toner image transferred to the sheet P is prevented.

Specifically, in the present exemplary embodiment, the contact region 50A is formed in a range of 10 mm or more. Here, consider a configuration in which the contact region 50A is formed in a range of less than 10 mm (hereinafter, this configuration will be referred to as a "fifth configuration"). In the fifth configuration, a gap is likely to be formed between the transfer belt 22 and the rotating body 36 in the electric field region 36B, and discharge may occur between the transfer belt 22 and the rotating body 36. If discharge occurs between the transfer belt 22 and the rotating body 36, a discharge defect may occur in the toner image to be transferred to the sheet P.

In contrast, as described above, in the present exemplary embodiment, the contact region 50A is formed in a range of 10 mm or more. Therefore, as compared to the fifth configuration, the gap is less likely to be formed between the transfer belt 22 and the rotating body 36 in the electric field region 36B, and the discharge is less likely to occur between the transfer belt 22 and the rotating body 36. Therefore, in the present exemplary embodiment, as compared to the fifth configuration, the discharge defect in the toner image transferred to the sheet P is prevented.

In the present exemplary embodiment, the contact region 50A is formed in a range of 50 mm or less. Here, consider a configuration in which the contact region 50A is formed in a range exceeding 50 mm (hereinafter, this configuration will be referred to as a "sixth configuration"). Since the contact region 50A is long in the sixth configuration, abrasion of the toner image is likely to occur between the transfer belt 22 and the sheet P. Therefore, even when a minute speed difference occurs between the transfer belt 22 and the sheet P in the contact region 50A, a defect in which the toner image is abraded (that is, image abrasion defect) is likely to occur. In contrast, as described above, in the present exemplary embodiment, the contact region 50A is formed in a range of 50 mm or less. Therefore, as compared to the sixth configuration, the image abrasion defect is prevented.

Evaluation 1

In Evaluation 1, the pressure applied to the transfer belt 22 in the contact region 50A is changed in the configuration of the present exemplary embodiment, to evaluate the discharge defect of the toner image and the image scattering.

The pressure is measured using a tactile sensor system I-SCAN (manufactured by Nitta Corporation) as an example. A specific measurement method include, for example, (i) pulling out the rotating body 36 from a body of the image forming apparatus 10 and attaching a tactile sensor to the rotating body 36, then (ii) inserting the rotating body 36 into the body, (iii) bringing the rotating body 36 and the transfer belt 22 into contact with each other so as to form the same contact state as at a time of actual transfer, and (iv) obtaining a value 30 seconds after a tactile sensor value (KPa) is displayed as a measured value. A measurement position is a center of the contact region 50A (specifically, a center in a circumferential direction and the axial direction of the rotating body 36).

Evaluation Criteria

A: No discharge defect occurs in a toner image or no image scattering occurs

B: Some discharge defects occurs in a toner image or some image scatterings occur C: Discharge defects remarkably occur in a toner image or image scatterings remarkably occur Evaluation Results As shown in FIG. 7, it is found that when the pressure of 1.5 kPa or more is applied to the transfer belt 22 in the contact region 50A, the discharge defects are prevented in the toner image to be transferred to the sheet P. It is found that when the pressure of 15 kPa or less is applied to the transfer belt 22 in the contact region 50A, the image scattering is prevented.

Evaluation 2

In Evaluation 2, a length of the contact region 50A is changed in the configuration of the present exemplary embodiment, to evaluate a discharge defect in a toner image and an image abrasion defect.

Evaluation Criteria

A: No discharge defect occurs in a toner image or no image abrasion defect occurs B: Some discharge defects occur in a toner image or some image abrasion defects occur C: Discharge defects remarkably occur in a toner image or image abrasion defects remarkably occur Evaluation Results As shown in FIG. 8, it is found that when the contact region 50A exceeds the electric field region 36B (about 7 mm), the discharge defects were inhibited in the toner image transferred to the sheet P. Further, it was found that when the contact region 50A is formed in a range of 10 mm or more, a discharge defect is effectively prevented in the toner image to be transferred to the sheet P. It is found that when the contact region 50A is formed in a range of 50 mm or less, an image abrasion defect is prevented.

Modification

In the above exemplary embodiment, the gripper 42 as the example of the holding member have been illustrated as a configuration that physically holds the leading end portion of the sheet P. It is noted that the grippers 42 are not limited to this structure. For example, the grippers 42 may hold the leading end portion of the sheet P using an air suction force.

In the above exemplary embodiment, the opposing roller 33 is used as the example of the opposing member. It is be noted that the present disclosure is not limited thereto. For example, a member such as a pad on which the transfer belt 22 slides may be used as an example of the opposing member.

In the above exemplary embodiment, the support roller 50 is used as the example of the forming member. It is noted that the present disclosure is not limited thereto. For example, a member such as a pad on which the transfer belt 22 slides may be used as an example of the forming member.

The present disclosure is not limited to the above exemplary embodiment, and various modifications, changes, and improvements may be made without departing from the spirits of the present disclosure. For example, two or more of the modifications described above may be combined as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a rotating body;

a sprocket provided coaxially with the rotating body, the sprocket being configured to rotate integrally with the rotating body;

a chain comprising a holder configured to hold a leading end portion of a recording medium, the chain being wound on the sprocket, the chain being configured to rotate so as to transport the recording medium;

an annular shaped transfer belt supported by an opposing member opposing the rotating body at an opposing position, the transfer belt being configured to sandwich the recording medium transported by the chain between the transfer belt and the rotating body at the opposing position, wherein an image on an outer peripheral surface of the transfer belt is transferred to the recording medium in response to a transfer bias being applied between the rotating body and the opposing member; and a forming member that supports the transfer belt on an upstream side of the opposing position in a transport direction, the forming member being configured to form a contact region in which the transfer belt is brought into contact with the rotating body on the upstream side of the opposing position in the transport direction.

2. The image forming apparatus according to claim 1, wherein the rotating body is formed in a cylindrical shape, the opposing member comprises an opposing roller, the forming member comprises a forming roller, and the following relationship is satisfied:

an outer diameter of the rotating body>an outer diameter of the opposing roller≥an outer diameter of the forming roller.

3. The image forming apparatus according to claim 2, wherein the following relationship is satisfied:

the outer diameter of the rotating body>the outer diameter of the opposing roller>the outer diameter of the forming roller.

4. The image forming apparatus according to claim 3, wherein a pressure is applied to the transfer belt such that the transfer belt is in close contact with the recording medium, which is transported by the chain, in the contact region.

5. The image forming apparatus according to claim 4, wherein the contact region is broader than an electric field region formed by an application of the transfer bias, on the upstream side of the opposing position in the transport direction.

6. The image forming apparatus according to claim 3, wherein a pressure of 1.5 kPa or more is applied to the transfer belt in the contact region.

7. The image forming apparatus according to claim 6, wherein the pressure applied to the transfer belt in the contact region is equal to or less than 15 kPa.

8. The image forming apparatus according to claim 3, wherein the contact region is broader than an electric field region formed by an application of the transfer bias, on the upstream side of the opposing position in the transport direction.

9. The image forming apparatus according to claim 2, wherein a pressure is applied to the transfer belt such that the transfer belt is in close contact with the recording medium, which is transported by the chain, in the contact region.

10. The image forming apparatus according to claim 9, wherein the contact region is broader than an electric field region formed by an application of the transfer bias, on the upstream side of the opposing position in the transport direction.

11. The image forming apparatus according to claim 2, wherein a pressure of 1.5 kPa or more is applied to the transfer belt in the contact region.

12. The image forming apparatus according to claim 11, wherein the pressure applied to the transfer belt in the contact region is equal to or less than 15 kPa.

13. The image forming apparatus according to claim 2, wherein the contact region is broader than an electric field region formed by an application of the transfer bias, on the upstream side of the opposing position in the transport direction.

14. The image forming apparatus according to claim 1, wherein a pressure is applied to the transfer belt such that the transfer belt is in close contact with the recording medium, which is transported by the chain, in the contact region.

15. The image forming apparatus according to claim 14, wherein the contact region is broader than an electric field region formed by an application of the transfer bias, on the upstream side of the opposing position in the transport direction.

16. The image forming apparatus according to claim 1, wherein a pressure of 1.5 kPa or more is applied to the transfer belt in the contact region.

17. The image forming apparatus according to claim 16, wherein the pressure applied to the transfer belt in the contact region is equal to or less than 15 kPa.

18. The image forming apparatus according to claim 1, wherein the contact region is broader than an electric field region formed by an application of the transfer bias, on the upstream side of the opposing position in the transport direction.

19. The image forming apparatus according to claim 1, wherein the contact region is formed in a range of 10 mm or more.

20. The image forming apparatus according to claim 19, wherein the contact region is formed in a range of 50 mm or less.

* * * * *